United States Patent [19]

Herbst

[11] 4,112,637

[45] Sep. 12, 1978

[54] REMOVABLE PRESS ANCHOR WITH DESTRUCTIBLE ANCHOR BODY

[75] Inventor: Thomas Herbst, Munich, Germany

[73] Assignee: Dyckerhoff & Widmann Aktiengesellschaft, Munich, Germany

[21] Appl. No.: 767,316

[22] Filed: Feb. 10, 1977

[30] Foreign Application Priority Data

Feb. 16, 1976 [DE] Fed. Rep. of Germany ..... 2606095

[51] Int. Cl.[2] ..... E02D 5/74

[52] U.S. Cl. ..... 52/155; 405/259; 52/704; 85/71

[58] Field of Search ..... 61/45 B; 52/704, 708, 52/155–157, 166, 707, 706; 85/71, 72

[56] References Cited

U.S. PATENT DOCUMENTS

| | | | |
|---|---|---|---|
| 2,521,065 | 9/1950 | Kempton | 85/71 |
| 3,302,410 | 2/1967 | McLean | 52/704 |
| 3,389,561 | 6/1968 | Taylor | 61/45 B |
| 3,942,407 | 3/1976 | Mortensen | 85/71 |

FOREIGN PATENT DOCUMENTS

| | | | |
|---|---|---|---|
| 76,504 | 6/1954 | Netherlands | 52/704 |
| 1,404,825 | 9/1975 | United Kingdom | 61/45 B |

OTHER PUBLICATIONS

Conmat Publication, four pages, dated Aug. 1, 1974.

*Primary Examiner*—James L. Ridgill, Jr.
*Attorney, Agent, or Firm*—Toren, McGeady and Stanger

[57] ABSTRACT

A removable press anchor is formed of a tubular sheathing with a traction element carried for longitudinal movement within the sheathing. An anchor body is releasably connected to the traction element and is embedded in a press body which is formed by pressing in hardening material. The anchor body is formed of glass fibers so as to be destructible by cutting forces extending transverse to the longitudinal axis thereof and able to absorb large forces in the direction of its longitudinal length and only small forces in the direction transverse to its longitudinal length. In one embodiment, the anchor body is formed as a pressure member, and in a further embodiment it is formed as a traction member.

6 Claims, 4 Drawing Figures

1
2
3
4
5
6
7
8
10
11
12
13
14
II
IV
I

REMOVABLE PRESS ANCHOR WITH DESTRUCTIBLE ANCHOR BODY

BACKGROUND OF THE INVENTION

The invention relates to a removable press anchor, which includes a traction element held for longitudinal movement inside a tubular sheathing and releasably connected with an anchor body which is embedded in the press body formed by the pressing in of hardening material.

Ground anchors for the temporary anchoring of construction members must often be removed after they have fulfilled their function. This is the case, for example, when anchored construction pit walls extend up to the borderline of an adjacent lot and are anchored into the latter. Even if the traction elements (or anchor rods) of these anchors are threaded and are connected to an anchor head by screwing, so that they can be unscrewed after use and recovered, the part of the anchor which is firmly connected with the ground by pressing, i.e. the press body, will remain in the ground. When the adjacent lot is subsequently excavated over a large area, such as with leveling caterpillar tractors, these press bodies, now lying loosely in the ground, and seldom having a length of more than about 4 to 8 meters, can usually be removed easily. However, there are cases where foundation structures, e.g. a slotted wall, must be installed exactly in the region of the remaining anchor parts. The excavated area of this region is loosened and hauled with special machinery for loosening the earth, such as drill grabs or slotted wall grabs. The remaining press bodies with the anchor parts firmly cemented in represent an almost insurmountable obstacle to the use of this equipment.

It is accordingly the object underlying the present invention to provide a removable press anchor in such a way that the press body and the anchor parts remaining therein can be removed simply and safely by standard earth loosening tools engaging the press body crosswise (i.e. transverse) to its longitudinal direction.

The foregoing object, along with other objects, features and advantages of the present invention will become more apparent from the detailed description in conjunction with the accompanying drawings to be described hereinafter.

SUMMARY OF THE INVENTION

The invention accomplishes the object of the invention by providing an anchor body to be embedded in the press body which consists of a material which can absorb great forces in the direction of its longitudinal axis, but only small forces transverse to its longitudinal axis, as for example glass fibers.

The advantage of the invention, which is evident for example when using glass fibers, is that for the transmission of the anchoring forces from the traction element to the press body a material is used which, in its effects on forces engaging crosswise to its longitudinal direction, is comparable to the material of the press body itself, so that a destruction of the anchor body together with the press body is possible at any desired point of its length after the traction element, releasably connected therewith, has been removed.

In one embodiment of the invention, the press anchor is equipped with an anchor body designed as a pressure member. It is expedient to form the anchor body from single rods arranged radially about the traction element when viewed in cross-section and possibly provided with surface profilations for greater adhesion, the rods being anchored under pressure at the ground-side end of the anchor in a distributor head connected with the traction member.

Alternatively, another embodiment provides an anchor body designed as a traction member in which the anchor body consists of a bundle of rods secured in an anchor head which in turn is releasably connected with the traction element. The individual rods of the bundle may then extend in undular form relative to each other, and there may be provided, in the regions of the largest diameter of the bundle, spacers for the rods, and in the regions of smallest diameter, tie cords around the rods.

BRIEF DESCRIPTION OF THE DRAWINGS

The drawing illustrates embodiments of the invention which will be explained hereinbelow.

DESCRIPTION OF THE INVENTION

Figures 1, 2, 3, 4:
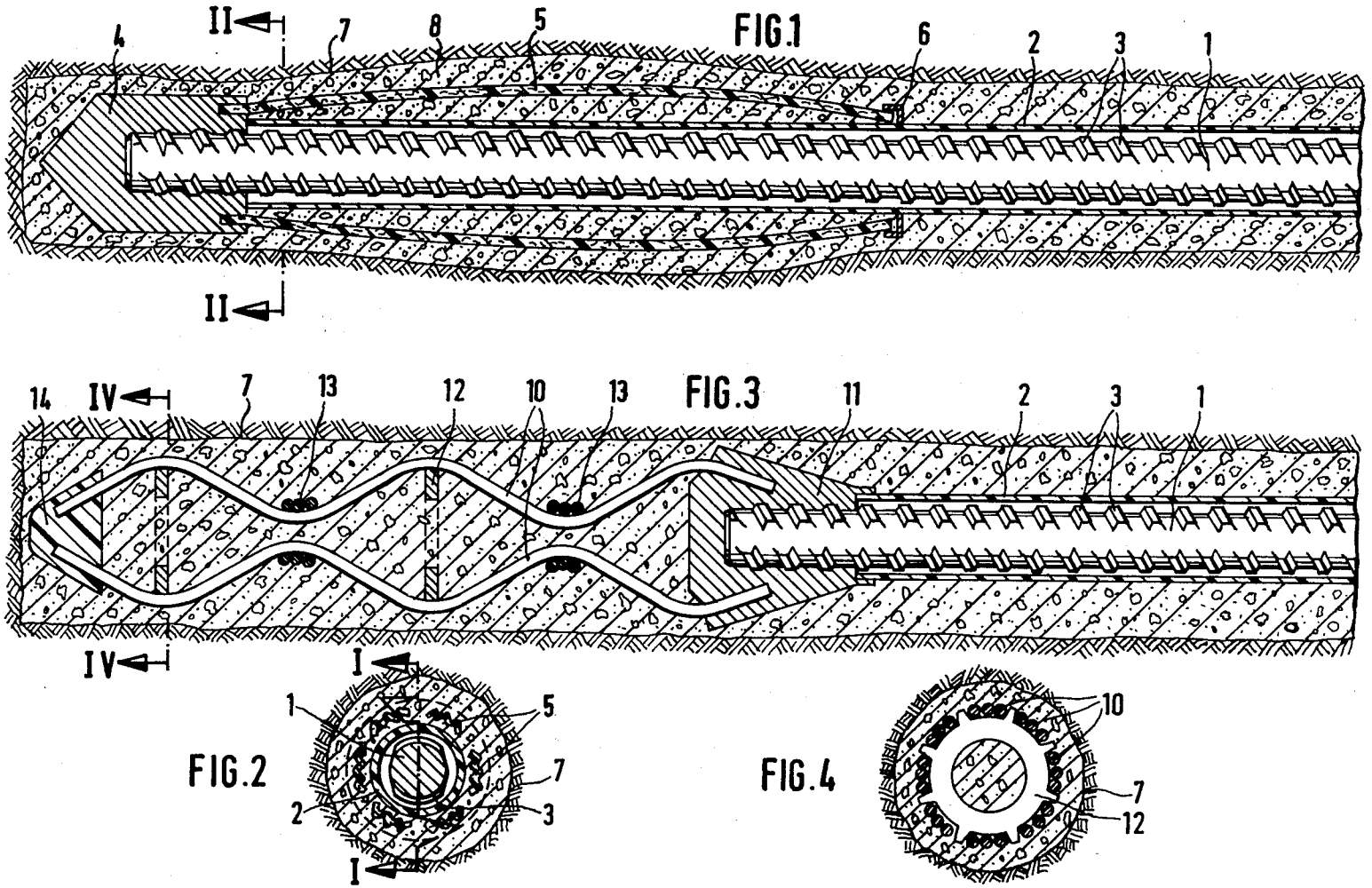
FIG. 1 is a sectional view taken longitudinally through a ground anchor of the present invention in the region of the press body.
FIG. 2 is a transverse sectional view taken along lines II—II in FIG. 1.
FIG. 3 is a longitudinal sectional view similar to that of FIG. 1 showing a further embodiment of a press anchor according to the invention.
FIG. 4 is a transverse sectional view taken along lines IV—IV in FIG. 2.

Referring now in more detail to the drawings, the anchor according to the invention includes a traction element 1, which is surrounded over its entire length by sheathing tube 2, to maintain the traction element 1 longitudinally movable and tensionable. In both forms of construction of the invention shown herein, the traction element 1 consists of a steel rod provided with hot-rolled ribs 3 forming a partial thread, so that the rod can at any desired points of its length be connected with correspondingly designed anchor bodies by screwing.

In the example of the construction shown in FIGS. 1 and 2, a distributor head 4 is arranged at the ground-side end of the traction element 1. The distributor head 4 has an internal thread corresponding to the partial thread of the traction element 1 so that it may be screwed onto the end of the traction element 1. Also, the sheathing tube 2 terminates in the distributor head, so as to ensure a tight connection.

Inserted in the distributor head 4 are pressure rods 5 evenly distributed radially about the traction element 1. In the example shown, all pressure rods are of the same length, but they may alternatively have different lengths. The rods 5 are held in place at one end thereof at the distributor head 4, and at the other end, by a retention element 6. They are slightly curved toward the wall 7 of the drill hole, resulting in an outwardly directed compressive force component.

When the anchor has fulfilled its purpose, the traction element 1, held for longitudinal movement inside the sheathing tube 2, can be screwed out of the distributor head 4. The press body 8 will then contain, in the anchoring region, only the rods 5, which can easily be destroyed by cutting forces extending transverse to their longitudinal direction. The sheathing tube 2 offers no appreciable resistance to the earth loosening tools.

In the embodiment shown in FIGS. 3 and 4, the traction element 1 again consists of a steel rod 1 provided with ribs 3. The traction element 1 is guided in the region of its free length in a sheathing tube 2. The actual anchor body in this construction, consists of an extension of the traction element 1, namely a bundle of rods 10, which are held under traction at one end thereof in an anchor head 11. In principle the anchor head 11 may be of any design, in order to be adapted to the respective requirements.

In the example of FIG. 3, the individual rods 10 of the bundle are undular. At the points of largest diameter (i.e. greatest separation between rods) are spacers 12; at the points of smallest diameter (i.e. least separation) are tie cords 13, e.g. of wire. The rods 10 are held at the other end thereof (the ground side) in a foot portion 14.

While the invention has been described and illustrated with respect to certain embodiments which produce satisfactory results, it will be understood after appreciating the purpose of the invention, that various other changes and modofication may be made without departing from the spirit and scope of the invention.

What is claimed is:

1. A removable press anchor comprising a tubular sheathing, a traction element removably carried and arranged for longitudinal movement within said tubular sheathing, and a destructible anchor body releasably connected with said traction element, said anchor body being embedded in a press body formed by pressing in hardening material, said anchor body comprising a head and a plurality of rods connected thereto being formed of glass fibers, whereby said anchor body is destructible by exerting forces extending transverse to the longitudinal axis thereof so as to be capable of absorbing large forces in the direction of its longitudinal length and only small forces in the direction transverse to its longitudinal length.

2. The removable press anchor according to claim 1 wherein said anchor body is formed as a pressure member and comprises a plurality of individual rods radially arranged about said traction element, and a distributor head located at the ground-side end of said anchor being removably connected to one end of said traction element, said rods being connected at one end thereof to said distributor head.

3. The removable press anchor according to claim 2 wherein said rods are provided with surface profilations to increase adhesion.

4. The removable press anchor according to claim 1 wherein said anchor body is formed as a traction member and comprises a bundle of rods secured at one end thereof to an anchor head releasably connected to said traction element.

5. The removable press anchor according to claim 4 wherein each of said rods of said bundle extends in an undular form with respect to each other.

6. The removable press anchor according to claim 5 further comprising spacer elements located in the regions of greatest separation between said rods, and tie cords wound about said rods in the regions of least separation between said rods.

* * * * *